US006286686B1

(12) United States Patent
Kelsey et al.

(10) Patent No.: US 6,286,686 B1
(45) Date of Patent: Sep. 11, 2001

(54) HUTCH CHAMBER FOR JIG

(75) Inventors: Christopher George Kelsey, Glenelg; Ian McKenzie, Adelaide, both of (AU)

(73) Assignee: Lowan (Management) Pty Limited (AU)

( * ) Notice: Subject to any disclaimer, the term of this patent is extended or adjusted under 35 U.S.C. 154(b) by 0 days.

(21) Appl. No.: 09/486,081

(22) PCT Filed: Aug. 20, 1998

(86) PCT No.: PCT/AU98/00657

§ 371 Date: Feb. 28, 2000

§ 102(e) Date: Feb. 28, 2000

(87) PCT Pub. No.: WO99/08795

PCT Pub. Date: Feb. 25, 1999

(30) Foreign Application Priority Data

Aug. 20, 1997 (AU) ..... PO8691

(51) Int. Cl.[7] ..... B03B 7/00

(52) U.S. Cl. ..... 209/44; 209/425; 209/494; 209/451; 209/426

(58) Field of Search ..... 209/44, 494, 425, 209/453, 451, 426

(56) References Cited

U.S. PATENT DOCUMENTS

| | | | | |
|---|---|---|---|---|
| 1,141,419 | * | 6/1915 | Senn | 209/44 |
| 2,129,795 | * | 9/1938 | Storsand | 209/44 |
| 4,279,741 | * | 7/1981 | Campbell | 209/44 |
| 4,574,046 | * | 3/1986 | Sprow | 209/44 |
| 4,898,666 | * | 2/1990 | Kelsey | 209/44 |
| 4,998,986 | * | 3/1991 | Campbell | 209/44 |
| 5,114,569 | * | 5/1992 | Kelsey | 209/44 |
| 5,938,043 | * | 8/1999 | Costin et al. | 209/44 |

* cited by examiner

*Primary Examiner*—Donald P. Walsh
*Assistant Examiner*—Daniel K Schlak
(74) *Attorney, Agent, or Firm*—Smith, Gambrell & Russell, LLP

(57) ABSTRACT

A centrifugal jig has a container mounted for rotation about its longitudinal axis. The container is separated into an axial region and a peripheral region by ragging material supported by a screen. The peripheral region is composed of a series of hutch chambers with reciprocating wall portions located radially outside the screen, for repetitively dilating the ragging. The disclosed hutch chamber construction has a reciprocating wall portion which includes convergent wall surfaces that narrow toward the hutch chamber concentrate outlet.

7 Claims, 2 Drawing Sheets

HUTCH CHAMBER FOR JIG

BACKGROUND OF INVENTION

This invention relates to jigs which separate materials in a feed mixture on the basis of differing specific gravities and especially, but not exclusively, to centrifugal jigs of the general type described in International Patent Publication Nos. WO86/04269 and WO90/00090, in which a feed slurry is introduced into a rotating chamber bounded radially by a screen provided with ragging on its inner surface, the ragging being dilated repetitively to provide jigging action.

In WO86/04269, the ragging is dilated by pulsing the water in a hutch chamber which surrounds the screen. The water is pulsed by means of a diaphragm positioned at the base of the hutch chamber. In WO90/00090, a number of hutch chambers are circumferentially spaced about the jig screen, with the water in the hutch chambers being pulsed sequentially. Each hutch chamber has a diaphragm positioned below the screen, with the diaphragms being actuated by respective pushrods driven by a central crank assembly.

SUMMARY OF THE INVENTION

The present invention seeks to provide an improved pulsating mechanism for a jig.

There is disclosed herein a centrifugal jig having a container mounted for rotation about a longitudinal axis thereof, the container having an axial region, a peripheral region including one or more hutch chambers separated from the axial region by ragging which is radially restrained by screen means, means for introducing feed material to the axial region and means for pulsating fluid in said peripheral region so as to repetitively dilate said ragging, characterised in that the pulsating means is located directly radially outwards of said screen means and includes a reciprocating radially outer wall portion of the respective hutch chamber, each reciprocating wall portion including a concentrate outlet and a convergence leading thereto.

Preferably the peripheral region includes a plurality of said hutch chambers circumferentially spaced about said axis, each hutch chamber having respective reciprocating drive means for actuating the respective reciprocating wall portion.

Preferably the reciprocating drive means includes a lever driven by a respective pushrod, and crank means for reciprocating each of the pushrods.

Preferably each reciprocating wall portion is biased to non-pulsating position by centrifugal motion of the jig.

Preferably each reciprocating wall portion includes a diaphragm with a support block.

Preferably each reciprocating wall portion reciprocates along a substantially radial line of action which intersects with the screen.

There is further disclosed herein a method of separating components of a feed material on the basis of specific gravity, the method employing the centrifugal jig of claim 1 and including the steps of introducing the feed material to the axial region and repetitively dilating the ragging by activation of said pulsating means.

There is further disclosed herein a jig having at least one hutch chamber, said hutch chamber having a reciprocating wall portion which includes a concentrate outlet and a convergence leading thereto.

Preferably reciprocation of said wall portion causes pulsation of fluid in the hutch chamber so as to effect repetitive dilation of a ragging layer in the jig.

Preferably the jig is a centrifugal jig and wherein the hutch chamber is located radially outside a screen means which supports the ragging.

Preferably the jig is a gravity jig and the hutch chamber is located below a screen means which supports the ragging.

BRIEF DESCRIPTION OF THE DRAWINGS

Further preferred embodiments of the invention shall now be described with reference to the accompanying drawings, in which.

DESCRIPTION OF THE PREFERRED EMBODIMENTS

Figure 1:
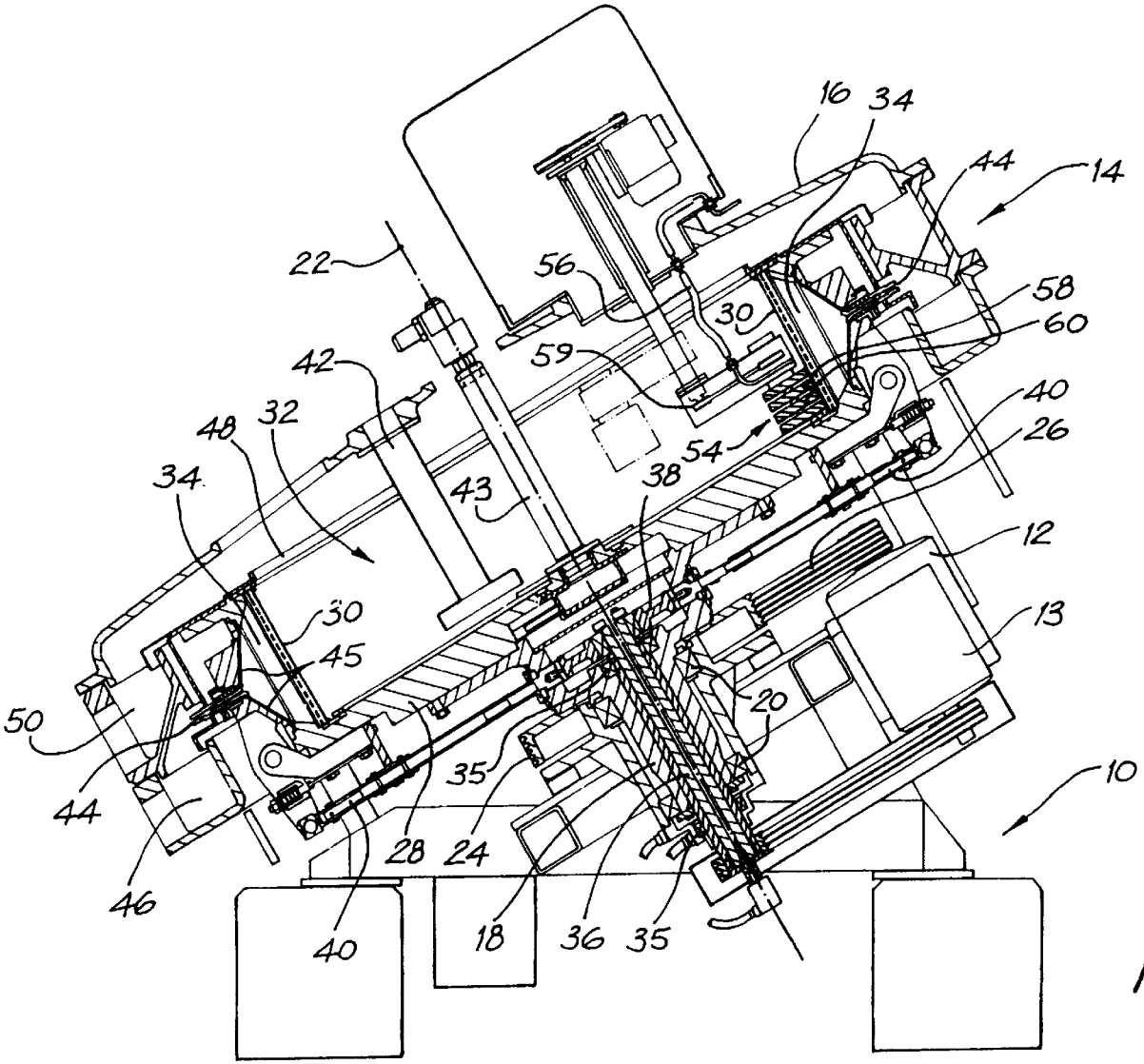
FIG. 1 is a sectional elevation of a centrifugal jig employing a preferred pulsing hutch arrangement.

FIG. 1 shows a centrifugal jig of the general type according to the Applicant's WO90/00090 but employing a pulsation mechanism according to the present invention. The general construction and operation of the jig are described in detail in that patent, the contents of which are incorporated herein by reference, and shall now be described here only briefly.

The centrifugal jig of FIG. 1 has a frame 10 supporting a jig drive motor 12, a crank drive motor 13, a fixed launder arrangement 14 and cover 16 and a jig main shaft 18 which is supported in bearings 20 to rotate about a rotational axis 22.

The main shaft 18 is driven by the jig drive motor 12 through jig drive pulley 24 and jig drive belt 26. Mounted on the main shaft is a screen housing 28 supporting a screen 30 defining an inner chamber 32 and a number of hutch chambers 34 circumferentially spaced about the screen mounted inside the jig main shaft for independent rotation in bearings 35 is a crankshaft 36 with crank 38 for reciprocating a respective pushrod 40 for each hutch chamber.

Ragging material 41 (shown in FIG. 2), such as run-of-mill garnet, aluminum alloy or lead glass balls, is provided on the inner surface of the screen 30. The ragging is held against the surface of the screen due to the rotation of the jig. The feed slurry entering the inner chamber 32 through the feed tube 42 migrates to the inner surface of the ragging.

Hutch water is supplied to tube 43, passing through bores (not shown) in the screen housing 30, into each of the hutch chambers 34 circumferentially spaced about the screen. The crank 38 sequentially reciprocates a series of radially extending pushrods 40, with each pushrod in turn reciprocating a respective hutch chamber 34, as will be described below with reference to FIG. 2. The reciprocation of the hutches causes pulsation of the water in the respective hutches.

The ragging is repetitively dilated by the pulsation of the hutch water. This dilation allows the higher specific gravity material in the feed slurry to pass through the ragging and the screen and enter the hutch chambers. The concentrate material then travels along the convergent walls 45 of the hutch to the radially outermost part of the hutch chamber and passes through concentrate outlet spigot 44, which is aligned with a gap in the inner wall of a concentrate launder 46. The lower specific gravity material in the feed slurry does not pass through the ragging, but passes upwardly and escapes past the open top 48 of the inner chamber and then to a tailings launder 50.

The jig of FIG. 1 is mounted for rotation on an inclined axis 22 so that the ragging and feed material in the jig will fall to the lower side of the jig when the jig is stopped or is rotated only slowly. The inclined axis also requires the use of only one outlet from each of the tailings and concentrate launders.

Screen cleaning apparatus 54 is mounted on the stationary jig cover 16 and extends into the high side of the jig, pivoting and retracting between a cleaning position (shown in FIG. 1) for cleaning the screen and a withdrawn position (shown in ghost) radially inwards of the jig feed material, during normal operation of the jig. The cleaning apparatus includes a high pressure water spray 56 and a series of scraper wheels 58 depending from cantilevered cleaner head 59 and acting against the inner surface of the screen, which will typically have a large number of circumferentially elongate slots extending therethrough. The wheels have a series of projecting blades 60 disposed diagonally on their circumference for forcing particles accumulated on the screen to be sheared off at the screen surface and then forced through the screen by the water spray. The wheels are resiliently mounted so as not to cause damage to the screen when an unusually resistant particle is encountered.

In an unillustrated modification, the screen cleaner can include a plurality of spring-mounted buttons on the end face of an enlarged cantilevered cleaner head 59 instead of using scraper wheels 58. The buttons may be moved up and down across the screen surface to shear off lodged particles for removal by the water spray 56.

The screen cleaning arrangement is applicable to centrifugal jigs and other equipment employing rotating screens.

Figure 2:
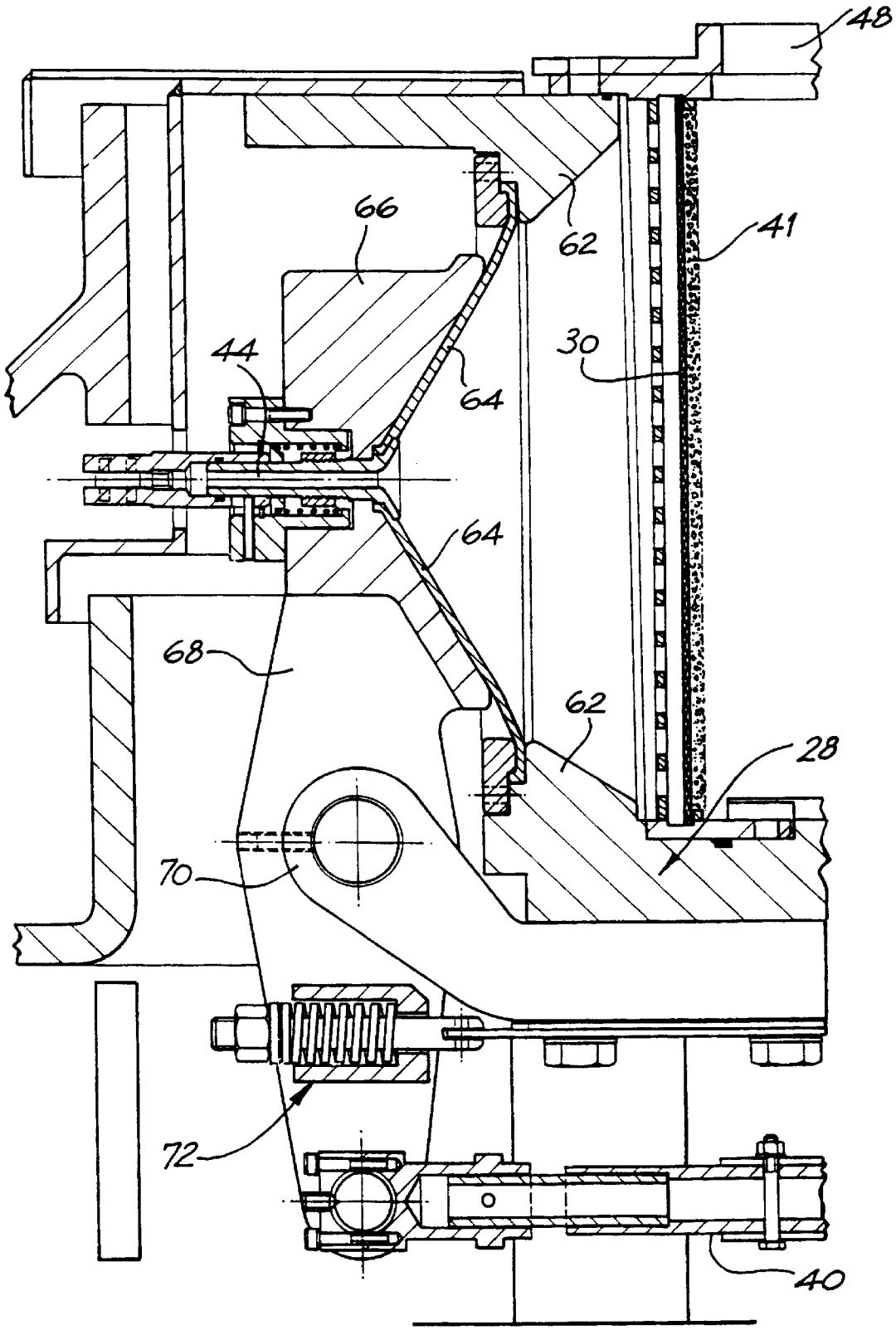
FIG. 2 is a sectional elevation of the screen, hutch and pulsating assembly shown in FIG. 1.

FIG. 2 illustrates the new pulsing hutch assembly in more detail.

With reference to FIG. 2, the inner surfaces of the hutch chamber walls are convergent in the direction of travel of a particle—i.e. radially outwards for a centrifugal jig as illustrated, or downwards for a non-rotary jig (not shown)—for example conical or rectangular pyramidal, with the concentrate outlet spigot 44 at its apex. The radially inwards portion 62 of the hutch is part of the casting of the jig screen housing 28, while the radially outwards part surrounding and attached to the outlet spigot 44 is formed by a diaphragm 64 backed by a support block 66. Each support block is attached to the upper end of a lever 68 pivoting about a fulcrum member 70 attached to the screen housing 28. The lower end of each lever is attached to a respective pushrod 40.

When each pushrod 40 is forced radially outwards by the crank 38, the respective lever 68 forces radially inwards movement of the hutch diaphragm 64, with the resultant pulsation of the hutch water in the hutch chamber causing dilation of the ragging. The concentrate material passes through the ragging and exits the hutch chamber via outlet spigot 44 as discussed above in relation to FIG. 1.

The heavy block 66 behind the diaphragm causes the hutch to be strongly biased toward the radially outwards (non-pulsing) position under influence of the centrifugal motion of the jig. This causes the hutch to quickly and positively return to this position after actuation of the pushrod by the crank, holding the pushrods 40 against the crank 38 with little or no "bounce". This is an advance over the prior art, in which the pulse water pressure was used to force the diaphragm return, and gives protection against damage to the machine in the event of the hutch water supply being interrupted.

A spring actuated lever return 72 may also be provided to hold the hutch in the non-pulsed position when the jig is stationary or is being rotated at very low speeds for routine maintenance.

By providing the pulsators directly and centrally opposite the respective portions of the screen, in accordance with the first form of the invention, the depth of water through which each pulse is transferred from the pulsator to the ragging is decreased. This allows higher pulsation rates with greater coupling between the pulsator and the ragging, resulting in less water hammer and smoother operation of the jig.

Other advantages of preferred forms of the invention are increased energy efficiency and smoother operation caused by a reduction in the volume of the hutch chamber, and thus the volume of water pulsated, as it is no longer necessary to extend the hutch chamber below the level of the screen. The volume of the hutch may be further reduced as the the rapid pulsation of the hutch wall portion containing the convergent walls and concentrate outlet assists discharge of the concentrate from the hutch. Higher density concentrate slurries can pass through the hutch and the wall angle of the hutch can be reduced without accumulation of concentrate on the hutch wall, thus allowing the use of a flatter, more compact hutch. The reduction in hutch volume gives scope for production of higher capacity jigs than capable with the prior art pulsation mechanisms.

A yet further advantage is more even dilation of the bed of ragging, allowing more efficient use of the screen area and therefore increasing the throughput capacity of the jig, due to the pulsator.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, the scope of the invention being indicated by the appended claims rather than the foregoing description, and all changes which come within the meaning and range of equivalency of the claims are therefore intended to be embraced therein.

What is claimed is:

1. A centrifugal jig having a container mounted for rotation about a longitudinal axis thereof, the container having an axial region, a peripheral region including one or more hutch chambers separated from the axial region by ragging which is radially restrained by screen means, means for introducing feed material to the axial region and means for pulsating fluid in said peripheral region so as to repetitively dilate said ragging, characterized in that the pulsating means is located directly radially outward of said screen means and includes a reciprocating radially outer wall portion of the respective hutch chamber, each reciprocating wall portion including a concentrate outlet and a convergence that narrows toward said concentrate outlet.

2. A method of operating the centrifugal jig of claim 1 including the steps of introducing a feed material to said axial region of the jig and separating said feed material into components by repetitively dilating said ragging by activation of said pulsating means.

3. A centrifugal jig having a container mounted for rotation about a longitudinal axis thereof, the container having an axial region, a peripheral region including a plurality of hutch chambers circumferentially spaced about said axis and separated from the axial region by ragging which is radially restrained by screen means, means for introducing feed material to the axial region and means for pulsating fluid in said peripheral region so as to repetitively dilate said ragging, characterized in that the pulsating means is located directly radially outward of said screen means and includes a reciprocating radially outer wall portion of the respective hutch chamber, each reciprocating wall portion including a concentrate outlet and a convergence that narrows toward said concentrate outlet, each hutch chamber having a respective reciprocating drive means for actuating the respective reciprocating wall portion.

4. A centrifugal jig according to claim 3 wherein the reciprocating drive means includes a lever driven by a respective pushrod, and crank means for reciprocating each of the pushrods.

5. A centrifugal jig according to claim 3 wherein each reciprocating wall portion is biased to a non-pulsating position by centrifugal motion of the jig.

6. A centrifugal jig according to claim 5 wherein each reciprocating wall portion includes a diaphragm with a support block.

7. A centrifugal jig having a container mounted for rotation about a longitudinal axis thereof, the container having an axial region, a peripheral region including a plurality of hutch chambers separated from the axial region by ragging which is radially restrained by screen means, means for introducing feed material to the axial region and means for pulsating fluid in said peripheral region so as to repetitively dilate said ragging, characterized in that the pulsating means is located directly radially outward of said screen means and includes a reciprocating radially outer wall portion of the respective hutch chamber, each reciprocating wall portion including a concentrate outlet and a convergence that narrows toward said concentrate outlet, wherein each reciprocating wall portion reciprocates along a substantially radial line of action which intersects with the screen means.

* * * * *